United States Patent [19]

Becker

[11] Patent Number: 4,565,394

[45] Date of Patent: Jan. 21, 1986

[54] DUAL-WALL DRILL PIPE

[76] Inventor: Floyd W. Becker, R.R. 9 Site 1, Box 15, Calgary, Alberta, Canada

[21] Appl. No.: 416,699

[22] Filed: Sep. 10, 1982

[30] Foreign Application Priority Data

Feb. 24, 1982 [CA] Canada ..... 396949

[51] Int. Cl.[4] ..... F16L 39/00

[52] U.S. Cl. ..... 285/141; 285/133 A; 285/319

[58] Field of Search ..... 285/133 A, 142, 143, 285/140, 319, 141

[56] References Cited

U.S. PATENT DOCUMENTS

| | | | |
|---|---|---|---|
| 2,836,247 | 5/1958 | McCulloch . | |
| 3,052,301 | 9/1962 | Watts et al. | 285/142 X |
| 3,255,612 | 6/1966 | Mayer . | |
| 3,280,920 | 10/1966 | Scott . | |
| 3,471,177 | 10/1969 | Garrett et al. | 285/319 X |
| 3,741,589 | 6/1973 | Herd et al. | 285/141 X |
| 3,919,902 | 11/1975 | Johnson . | |
| 4,037,672 | 7/1977 | Hodge . | |
| 4,102,418 | 7/1978 | Kammerer . | |
| 4,190,119 | 2/1980 | Loftis . | |
| 4,423,889 | 1/1984 | Weise | 285/302 X |
| 4,476,940 | 10/1984 | Reichert . | |

FOREIGN PATENT DOCUMENTS

| | | |
|---|---|---|
| 1410739 | 10/1964 | France . |
| 253551 | 2/1927 | United Kingdom . |
| 1133744 | 11/1968 | United Kingdom . |

*Primary Examiner*—Richard J. Scanlan, Jr.
*Attorney, Agent, or Firm*—Hayes, Davis & Soloway

[57] ABSTRACT

The specification describes a dual-wall drill pipe section comprising an outer pipe member having a box end formed with an internal thread and a pin end formed with an external thread for engagement with the box end of another outer pipe member, the bore of one of the ends of the outer pipe member is formed with a shoulder and a circumferential, inwardly facing groove axially spaced from the shoulder, an inner pipe member concentrically disposed within the outer pipe member so as to define an annular passage between the inner and outer pipe members, spacer members connected to each end of the inner pipe member and disposed in the annular passage for maintaining concentricity between the inner and outer pipe members, the spacer members at one end of the inner pipe being formed with a shoulder for abutting engagement with the shoulder of the outer pipe member so as to axially locate and support the inner pipe member within the outer pipe member, and at least one spring member connected to the inner pipe member and having a portion engageable with the groove of the outer pipe member for resiliently and frictionally retaining the inner pipe member within the outer pipe member during drilling, storage and handling of an assembled pipe section.

9 Claims, 8 Drawing Figures

DUAL-WALL DRILL PIPE

This invention relates to a dual-wall drill pipe section for use in a drill string for drilling in earth formations.

BACKGROUND OF THE INVENTION

Dual-walled drill pipe used for drilling bore holes in earth formations are well known. Generally, bore holes are formed by rotating or percussively-rotating a drill string, which may be up to several hundred feet in length, into an earth formation using a drilling apparatus or rig. The drill string is comprised of an outer pipe string, to the lower end of which is connected a drill bit, and an inner pipe string. The inner and outer pipe strings together define an annular passageway for communicating fluid, such as air, to the bottom of the bore hole while the inner pipe string defines a bore which serves to return the air and cutting bits to the surface.

The outer pipe string is formed by a plurality of serially, threadedly connected lengths of pipe. The outer pipe string serves to transfer rotary and/or percussive forces to the cutting or drill bit and absorb axial forces such as those imposed when extracting the drill string from the bore hole. The axial forces may be substantial depending upon the length of the drill string. Accordingly, the outer pipe string is a high strength assembly which must be designed to withstand these loads.

The inner pipe string is also formed by a plurality of serially, connected lengths of pipe, although not threadedly connected. The primary function of the inner pipe string is to define the two above mentioned fluid passageways. It need not transfer rotary or percussive forces to the drill bit and, accordingly, need not meet the high strength requirements of the outer pipe string. Thus, it may be constructed of thinner-walled tube.

In order to minimize the strength requirements and, hence the size of the inner pipe, it is known to premount and secure an inner pipe to an associated outer pipe so as to form a dual-wall drill pipe section or assembly. In this manner, the weight of each inner pipe is transferred directly to its adjacent outer pipe. A drawback of this arrangement is that if either the inner or outer pipe is damaged, it is difficult to separate the two lengths of pipe so as to replace the damaged pipe. On the other hand, if the inner pipe is simply vertically supported within the outer pipe, the assembly may be difficult to handle prior to erecting or subsequent to dismantling a drill string because of the tendency of the two pipes to telescopically slide with respect to one another.

There is a need, therefore, for a dual-wall drill string section or assembly in which the inner pipe member is removably mounted within the outer pipe member so as to facilitate separation of the two pipe members in the event that one of the two members is damaged and must be replaced and yet positively retained therein to facilitate handling. The assembly must also be arranged so that no rotary forces are transmitted from the outer pipe member to the inner pipe member during drilling.

SUMMARY OF THE INVENTION

The present invention seeks to provide a dual-walled drill pipe arrangement which overcomes the aforementioned difficulties and, in particular, an arrangement which minimizes the wall thickness of the inner pipe string and facilitates the storage, handling and assembling of drill strings. In accordance with one aspect of the invention, the inner and outer pipe members are formed with cooperating shoulders which when engaged serve to locate an inner pipe member within an associated outer pipe member and transfer the weight of the inner pipe member and any other axial loads applied to the inner pipe member directly to its associated outer pipe member. As a result, the lower inner pipe members of the inner drill string need not absorb any more load than the inner pipe members at the upper end of the bore holes thereby considerably reducing the strength requirements and cost of the inner pipe string. In accordance with another aspect of the present invention, there is provided means releasably retaining the inner pipe member within the outer pipe member thus permitting preassembly of dual-walled drill pipe sections and facitilating storage and handling of drill pipe sections and assembling and dismantling of drill strings.

The present invention is generally defined as a dual-walled drill pipe section comprising, in combination, an outer pipe member having an internally threaded box end and an externally threaded pin end, and an inner pipe member telescopingly movable inwardly and outwardly of the outer pipe member and defining therewith a generally tubular fluid passage. Recess means is formed on one of the members within the passage and means associated with the other of the members is engageable with the recess means for releasably retaining the inner pipe member within the outer pipe member.

BRIEF DESCRIPTION OF THE DRAWINGS

These and other features of the invention become more apparent from the following description in which reference is made to the appended drawings wherein.

DETAILED DESCRIPTION OF A PREFERRED EMBODIMENT

Figure 1:
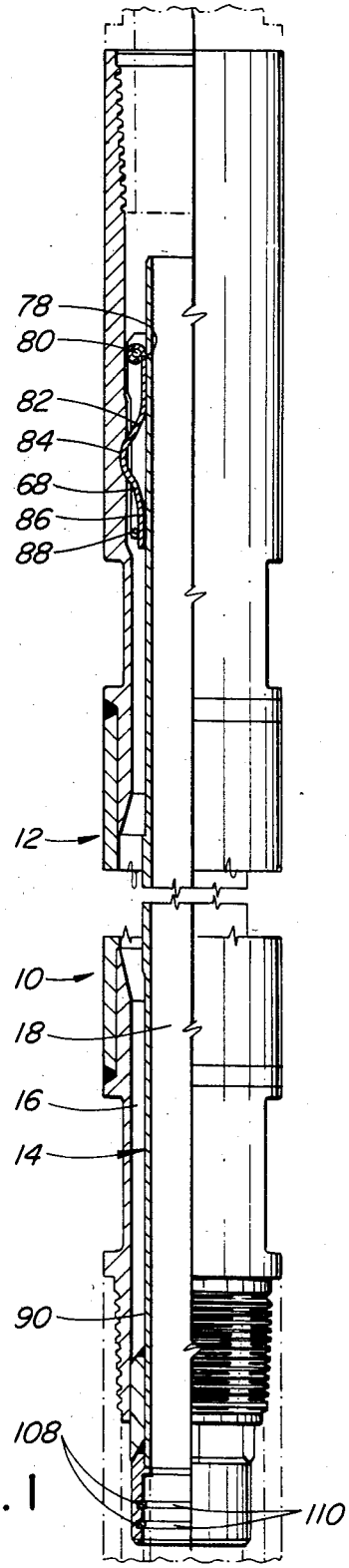
FIG. 1 is a broken, partial cross-sectional view of a drill pipe section of the present invention.

With reference to FIG. 1, the dual-wall drill pipe section of the present invention, generally designated by reference numeral 10, is generally comprised of an outer pipe member 12 and an inner pipe member 14. The inner and outer pipe members together define an annular passageway 16 which serves to communicate a fluid, such as air, from the surface to the cutting bit at the bottom of a bore hole. The inner pipe member defines a fluid passageway 18 for communicating the fluid and cutting chips from the bottom of the bore hole to the surface.

The dual-wall drill pipe section of the present invention provides an arrangement whereby the inner and outer pipe members are resiliently retained together during handling. Further, the pipe section of the present invention provides an arrangement whereby each outer pipe member supports its associated inner pipe member so as to minimize the strength requirements of the inner pipe member as well as failure of the inner pipe tubing. Still further, the drill pipe arrangement of the present invention is arranged such that that portion of the inner pipe which protrudes from the outer pipe section during storage and handling is effectively and conveniently reinforced so as to again minimize damage to the inner tubing.

Figure 2:
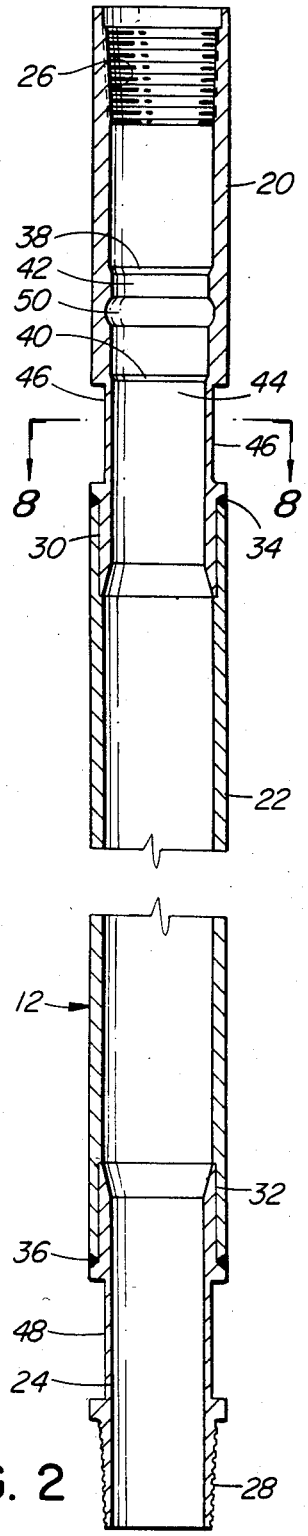
FIG. 2 is a broken, cross-sectional view of the outer pipe member of the drill pipe of the present invention.

With particular reference to FIG. 2 of the drawings, the outer pipe is generally comprised of three components in order to facilitate manufacture of the outer pipe member. In particular, the outer pipe member is comprised of a box 20, an elongated tube 22 and a pin 24. The three components are of uniform outside diameter as shown.

The box 20 includes an internal thread 26 at its free end while the pin 24 is formed with an external thread 28 for engagement with the thread 26 of the box of another outer pipe member. The opposite end of the box 20 is formed with a portion 30 of reduced diameter for reception in one end of tube 22. Similarly, the end of pin 24 remote from thread 28 is formed with a portion 32 of reduced diameter for reception within the opposite end of the tube 22. The box 20 and pin 24 are welded to their respective ends of tube 22 as by welds 34 and 36, respectively.

The bore of box 20 is stepped at 38 and 40 so as to define a first bore portion 42 of reduced diameter and a second bore portion 44 of reduced diameter. The steps 38 and 40 are chamfered so as to facilitate insertion of the inner pipe member within the outer pipe member. As will become clearer later, step or shoulder 38 serves to transmit axial loads which may be imparted on the inner pipe member directly to the outer pipe member. Step 40 is provided in order to provide adequate wall thickness in the vicinity of a pair of opposed flattened, transverse recesses 46. As is explained in copending Canadian application Ser. No. 496,947 filed Feb. 24, 1982, the recesses are provided for engagement with pipe coupling tools associated with the drill rig for dismantling a drill string. Similarly, the pin 24 is formed with opposed, flattened transverse recesses 48.

Reduced diameter portion 42 of the box 20 is also formed with a circumferential inwardly facing groove 50 which in the preferred form of the invention is arcuate in cross-section. Groove 50 is engageable with leaf springs mounted on the inner pipe member as will become clearer hereinafter.

Figure 3:
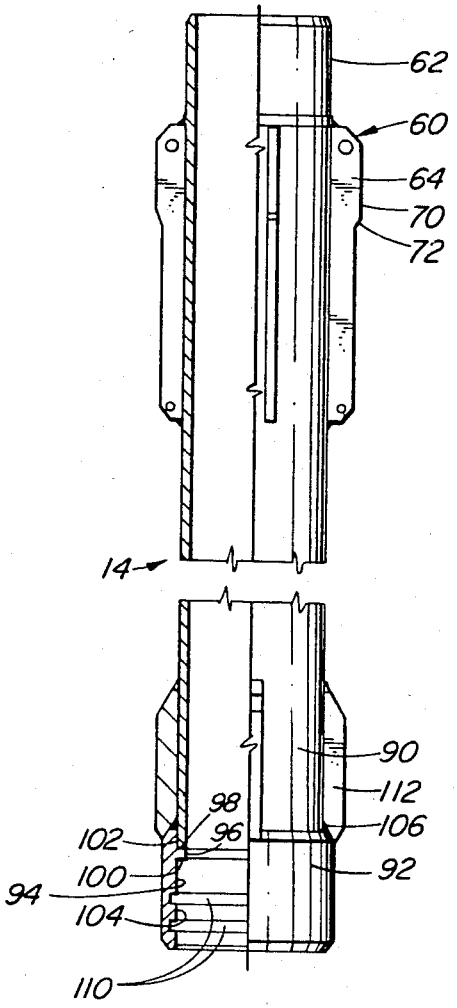
FIG. 3 is a broken, cross-sectional view of the inner pipe member of the drill pipe section of the present invention.

With reference to FIG. 3 of the drawings, inner pipe member 14 is formed with spacer means at each end thereof for maintaining concentricity between the inner and outer pipe members.

Figure 4:
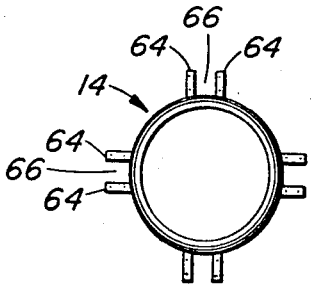
FIG. 4 is a top end view of the inner pipe member illustrated in FIG. 3.
Figure 5:
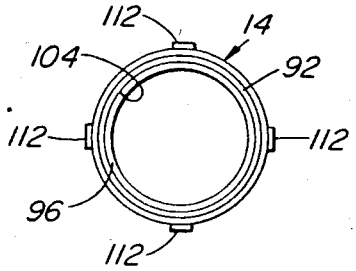
FIG. 5 is a bottom view of the inner pipe member illustrated in FIG. 3.

The spacer means 60 disposed at the upper end 62 of the inner pipe 14 is comprised of four pairs of elongated, longitudinally extending spacer members or plates 64. As best shown in FIG. 4, the four pairs of spacer members are equally angularly spaced about inner pipe 14. Each pair of spacer members 64 define a radially outwardly facing channel or chamber 66 in which is disposed an elongated leaf spring 68 as shown in FIG. 1.

Each spacer member is of the form of a bar of metal or plate welded to the outer periphery of inner pipe 14 and having an outer edge 70 which conforms to the shape of the inner bore of the outer pipe and dimensioned with respect to the axis of the inner pipe so as to be in sliding contact with the bore of the outer pipe. Members 64 each define a shoulder 72 abuttingly engageable with shoulder 38 of the outer pipe whereby the inner pipe is vertically supported in the outer pipe when the pipe section is held in an upright position.

Figure 6:
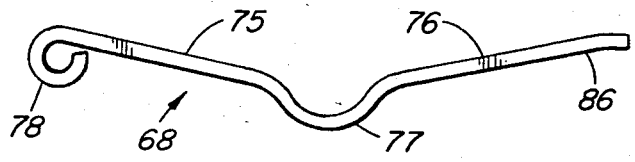
FIG. 6 is an edge view of the elongated leaf spring resiliently retaining together the inner and outer pipe members.
Figure 7:
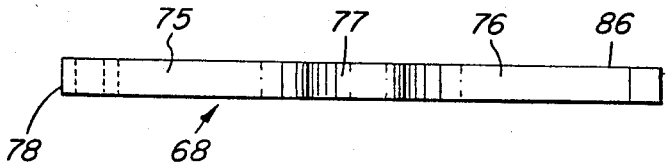
FIG. 7 is a top view of the spring illustrated in FIG. 6.
Figure 8:
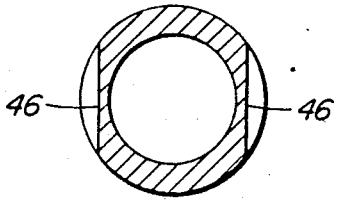
FIG. 8 is a cross-section through section line 88 of FIG. 2.

As shown in FIGS. 6 and 7, each leaf spring 68 is generally V-shaped in edge view and has a pair of arms 75 and 76 which diverge from one another from an apex 77 shaped to mate with arcuate groove 50 in outer pipe 12. The end of arm 75 is formed with an eye 78 for receiving a transverse pin 80 (FIG. 1) extending between the upper ends of a pair of spacer members 64. End 86 of arm 76 is formed to abuttingly engage and, to a limited extent, slide along the outer periphery of inner pipe 14. To prevent springs 68 from moving about and facilitate assembly of the pipe section, a transverse pin 88 is provided at the lower ends of spacer members 64 so as to confine end 86 of arm 76 between pin 88 and the inner pipe, as best shown in FIG. 1.

Thus, when the inner pipe member 14 is inserted into the box end of outer pipe member 12 and telescopically moved inwardly thereof, springs 68 are radially inwardly depressed until apices 77 reach and engage groove 50. So positioned, leaf springs 68 serve to frictionally and releasably retain the inner pipe member 14 within an outer pipe member 12 thereby facilitating storage and handling of the assembly.

Secured to the lower end 90 of the inner pipe member 14 is a tubular connector member 92 having a bore 94 formed with an annular rib 96 defining opposed annular shoulders 98 and 100. Rib 96 defines an upper bore portion 102 and a lower bore portion 104. Bore portion 102 telescopingly receives the lower end 90 of tube 14 to which the upper end of the connector is welded at 106 as shown in FIG. 3. The lower bore portion 104 of bore 94 is adapted to telescopingly and sealingly receive the upper end 62 of another inner pipe member. A pair of O-rings 108 disposed in grooves 110 serve to seal adjacent ends of connected inner pipe members.

Extending longitudinally upwardly from the connector member 92 are a plurality of equally angularly spaced spacer members 112 which serve to both concentrically dispose the lower end 90 of the inner pipe member 14 within the outer pipe member 12 and reinforce lower end 90 of inner pipe member 14. As is indicated in FIG. 1, the lower end of the inner pipe projects axially outwardly of the lower end of the outer pipe member and, thus, is subject to damage during storage and handling. However, spacer members 112 and connector 92 serve to protect and reinforce the end of the inner pipe member.

In order to assemble a pipe section, the lower end 90 of an inner pipe member is inserted into box end 20 of an outer pipe member and telescopingly moved along the outer pipe member until projection 84 of the leaf springs 68 enter and resiliently engage groove 50 in box 20 of the outer pipe member 12 and shoulders 38 and 72 of the outer and inner pipe members, respectively, abuttingly engage. When so assembled, springs 68 serve to retain the inner pipe member within the outer pipe member, even if the pipe section is inverted. In order to dismantle a pipe section, an axial, upwardly directed force of a magnitude which is sufficient to radially inwardly depress springs 68 is applied to the lower end 90 of the inner pipe member. The inner pipe member may then be readily telescopingly removed from the outer pipe member.

In order to assemble a drill string formed of the above described assembled pipe sections, the lower end 90 of the inner pipe member is inserted into the box end of a drill string and telescopingly moved downwardly therewithin until the pin 24 of the pipe section being assembled engages the upper box 20 of the drill string. Thereafter, the pipe section being assembled is rotated with respect to the drill string so as to threadedly engage the pin 24 of the new section with the box 20 of the drill string.

It will be appreciated that the spacer members 64 and springs 68 need not necessarily be disposed at the upper end of the inner pipe. Indeed, they may be disposed at the lower end of the pipe with the pin 24 suitably modified to receive these members. In this case, the connector member 92 and spacer members 112 would be disposed at the upper end of the inner pipe.

We claim:

1. A dual-wall drill pipe section for a drill string, formed from a plurality of serially connected drill pipe sections, for use in drilling in earth formations, said drill pipe section comprising, in combination:

an outer pipe member having an internally threaded box end, an externally threaded pin end, internal shoulder means extending inwardly from the bore of said outer pipe member, and recess means formed in said bore;

an inner pipe member adapted to be concentrically disposed within and telescopingly movable inwardly and outwardly of said outer pipe member, external shoulder means extending outwardly of the outer periphery of said inner pipe member and being engageable with said internal shoulder means for axially locating said inner pipe member within said outer pipe member and for supporting said inner pipe member in said outer pipe member when said section is in an upright position;

detent means associated with said inner and outer pipe members for releasably retaining said inner pipe member within said outer pipe member and permitting relative axial displacement of said pipe members upon application of predetermined opposed axial forces to said members, said detent means including a plurality of generally V-shaped leaf springs, an end of one arm of each said spring being secured to the outer periphery of said inner pipe member, the end of the other arm of each said spring being abuttingly and slidingly engageable with the outer periphery of said inner pipe member and the apex of each said spring means being spaced from said periphery and frictionally engageable with said recess means; and spacer means secured to each end of said periphery of said inner pipe member and being abuttingly engageable with said bore of said outer pipe member for maintaining concentricity between said inner and outer pipe members;

said spacer means including a plurality of angularly spaced longitudinally extending plates extending outwardly of said periphery and each having a longitudinal surface abuttingly engageable with said bore of said outer pipe.

2. A drill pipe section as defined in claim 1, said recess means being a circumferential recess.

3. A drill pipe section as defined in claim 2, said recess being arcuate in longitudinal cross section.

4. A drill pipe section as defined in claim 3, said apex of each said spring being shaped to mate with said recess.

5. A drill pipe section as defined in claim 2, said apex of each said spring being shaped to mate with said recess.

6. A drill pipe section as defined in claim 1, further including pin means extending between pairs of said plates at one end of each inner pipe member, said end of said one arm of each said leaf spring being connected to said pin means for pivotal movement thereabout.

7. A drill pipe section as defined in claim 1, said external shoulder means being formed on said plates at one end of said inner pipe member.

8. A drill pipe section as defined in claim 7, further including a connector member secured to one end of said inner pipe member for sealingly connecting said one end to the other end of another inner pipe member.

9. A dual-wall drill pipe section for a drill string formed of a plurality of serially connected drill pipe sections for drilling in earth formation, said drill pipe section comprising:

an outer pipe member having a bore, an internally threaded box end defining an upper end, an externally threaded pin end defining a lower end threadedly engageable with the box end of an adjacent outer pipe member, a concentric conical shoulder in said bore adjacent said box end and a concentric circumferential recess in said bore axially downwardly spaced from said shoulder;

an inner pipe member adapted to be concentrically disposed within and telescopingly moveable inwardly and outwardly of said outer pipe member and defining therewith a first annular fluid passage and having a bore defining a second fluid passage, first spacer means extending from the outer periphery of said inner pipe member adjacent one end thereof defining the upper end, said first spacer means including a plurality of pairs of spaced longitudinally extending plates each having an outer longitudinal surface abuttingly engageable with said bore of said outer member, each said plate having a tapered shoulder abuttingly engageable with said conical shoulder for locating and supporting said inner pipe member within said outer pipe member, second spacer means extending from the outer periphery of said inner pipe member adjacent the other end thereof, said second spacer means comprising a plurality of spaced longitudinally extending plates abuttingly engageable with said bore of said outer pipe member; and means for resiliently retaining said inner pipe member within said outer pipe member, said retaining means including a generally V-shaped leaf spring disposed between the plates defining said pairs of plates, the upper end of one arm of each leaf spring being pivotally connected to its associated pair of plates about a transverse axis, the lower end of the other arm of each said leaf spring being abuttingly engageable with and longitudinally slidable along said periphery and the apex of each said leaf being spaced outwardly of said periphery, shaped to mate with said recess and being engageable with said recess when said shoulders are abuttingly engaged for releasably retaining said inner pipe member within said outer pipe member.

* * * * *